US009387369B2

(12) United States Patent
Yamamoto

(10) Patent No.: US 9,387,369 B2
(45) Date of Patent: Jul. 12, 2016

(54) GOLF CLUB

(71) Applicant: DUNLOP SPORTS CO. LTD., Kobe-shi, Hyogo (JP)

(72) Inventor: Akio Yamamoto, Kobe (JP)

(73) Assignee: DUNLOP SPORTS CO. LTD., Kobe-Shi (JP)

( * ) Notice: Subject to any disclaimer, the term of this patent is extended or adjusted under 35 U.S.C. 154(b) by 0 days.

(21) Appl. No.: 14/290,679

(22) Filed: May 29, 2014

(65) Prior Publication Data

US 2014/0357398 A1 Dec. 4, 2014

(30) Foreign Application Priority Data

May 30, 2013 (JP) ..... 2013-114463

(51) Int. Cl.

| | |
|---|---|
| ***A63B 53/02*** | (2015.01) |
| ***A63B 53/12*** | (2015.01) |
| *A63B 53/10* | (2015.01) |
| *A63B 53/04* | (2015.01) |

(52) U.S. Cl.

CPC ..... *A63B 53/02* (2013.01); *A63B 53/12* (2013.01); *A63B 53/10* (2013.01); *A63B 2053/0408* (2013.01); *A63B 2209/00* (2013.01); *A63B 2209/02* (2013.01)

(58) Field of Classification Search

CPC .... A63B 53/02; A63B 52/12; A63B 2209/00; A63B 2053/0408; A63B 2209/02; A63B 53/10

See application file for complete search history.

(56) References Cited

U.S. PATENT DOCUMENTS

| | | | | | |
|---|---|---|---|---|---|
| 5,226,652 | A * | 7/1993 | Sato | 473/312 | |
| 5,454,563 | A * | 10/1995 | Nagamoto et al. | 473/312 | |
| 5,718,643 | A * | 2/1998 | Wright et al. | 473/297 | |
| 6,599,202 | B2 * | 7/2003 | Miyamoto | A63B 53/00 | 473/289 |
| 6,638,178 | B2 * | 10/2003 | Tseng | 473/306 | |
| 7,563,176 | B2 * | 7/2009 | Roberts et al. | 473/329 | |
| 2002/0137575 | A1 * | 9/2002 | Tseng | 473/305 | |
| 2002/0165038 | A1 | 11/2002 | Abe | | |

FOREIGN PATENT DOCUMENTS

| | | | |
|---|---|---|---|
| JP | 11-104275 | A | 4/1999 |
| JP | 2002-119623 | A | 4/2002 |
| JP | 2002-177417 | A | 6/2002 |
| JP | 2002-248184 | A | 9/2002 |

* cited by examiner

*Primary Examiner* — Stephen Blau

(74) *Attorney, Agent, or Firm* — Birch, Stewart, Kolasch & Birch, LLP

(57) ABSTRACT

A golf club includes a club head, and a shaft. The club head includes a hosel formed into a tubular body having a top end and a shaft insertion hole extending downwardly from the top end. The shaft includes a shaft main body and a reinforcing member. The shaft main body is formed into a tubular shape having a tip end, and an internal surface surrounding cavity therein. The reinforcing member has a specific gravity of not more than 2.0 and is fixed in the cavity of the shaft main body. The reinforcing member includes a first portion fitting the internal surface of the shaft main body. The first portion includes an uppermost edge positioned upwardly with respect to the top end of the hosel, and a lowermost edge positioned between the top end of the hosel and the tip end of the shaft main body.

16 Claims, 4 Drawing Sheets

GOLF CLUB

BACKGROUND OF THE INVENTION

1. Field of the Invention

The present invention relates to a golf club, and in particular to a golf club that may prevent breakage of a shaft without increasing the mass of the club.

2. Description of the Related Art

In order to maximize carry distance of a hit ball, various golf clubs with a small mass which typically include a lightweight shaft have been proposed. Unfortunately, since such a lightweight shaft usually has low strength, the shaft may break when hitting the golf ball. Furthermore, in a golf club with a tubular hosel into which the lightweight shaft is inserted, the shaft tends to break at or near the top end of the hosel when hitting due to a large bending deformation occurring thereto.

The Japanese Unexamined Patent Application Publication No. 2002-119623 discloses a golf club that includes a golf club head being not provided with a tubular hosel. Since such a golf club tends to have low bonding strength between the shaft and the golf club head, it might be difficult to expect satisfactory endurance.

The Japanese Unexamined Patent Application Publication No. 2002-248184 discloses a golf club shaft that includes a tubular shall main body having a tip end and a reinforcing pipe inserted into the shaft main body. Since the pipe continuously extends upwardly from the tip end of the shaft main body, it may increase the total mass of the golf club.

The Japanese Unexamined Patent Application Publication No. 2002-177417 discloses a golf club that includes a golf club head, a shaft, and a tapered ring for precisely centering the shaft into a shaft insertion hole of the golf club head. Unfortunately, the golf club may not be expected offering a feature to prevent breakage of the shaft.

The Japanese Unexamined Patent Application Publication No. 11-104275 discloses a golf club shaft that includes a tubular shaft main body, and a core inserted into the shaft main body. Since the core continuously extends upwardly from the tip end of the shaft main body, it may increase the total mass of the golf club.

SUMMARY OF THE INVENTION

The present invention has been worked out in the light of the circumstances described above, and has a main object of providing a golf club that may prevent breakage of a shaft without increasing the mass of the club.

According to one aspect of the invention, a golf club includes a golf club head, and a shaft. The golf club head includes a hosel which is formed into a tubular body having a top end and a shaft insertion hole extending downwardly from the top end. The shaft includes a shaft main body and a reinforcing member. The shaft main body is formed into a tubular shape having a tip end, and an internal surface surrounding axially extending cavity therein. The reinforcing member has a specific gravity in a range of not more than 2.0 and is fixed in the cavity of the shaft main body. The reinforcing member includes a first portion fitting the internal surface of the shaft main body, and the first portion having an uppermost edge and a lowermost edge. The uppermost edge of the first portion is positioned upwardly with respect to the top end of the hosel, and the lowermost edge of the first portion is positioned between the top end of the hosel and the tip end of the shaft main body.

According to another aspect of the invention, the reinforcing member may further comprise a second portion integrally with the first portion, and the second portion may comprise an axially extending thin portion having its outer surface separate from the internal surface of the shaft main body.

According to another aspect of the invention, the thin portion may be provided downward with respect to the first portion.

According to another aspect of the invention, the second portion may further comprise its terminal end provided downwardly with respect to the thin portion, and the terminal end may be fixed at the tip end of the shaft main body.

According to another aspect of the invention, the reinforcing member may further comprise a top portion extending upwardly from the uppermost edge of the first portion while reducing its outer diameter.

According to another aspect of the invention, the top portion may have a hemisphere-like shape.

According to another aspect of the invention, the uppermost edge of the first portion may be located in a distance of from 5 to 50 mm in a shaft axial direction from the top end of the hosel.

According to another aspect of the invention, the lowermost edge of the first portion be located in a distance of not more than 20 mm in a shaft axial direction from the top end of the hosel.

According to another aspect of the invention, the reinforcing number may be provided with a vent passage which communicates a lower space of first portion in the cavity with an upper space of the first portion in the cavity.

In accordance with the present invention, the shaft comprises a shaft main body formed into a tubular shape having an internal surface surrounding an axially extending cavity therein, and a reinforcing member fixed in the cavity of the shaft main body. Since the reinforcing member has a specific gravity in a range of not more than 2.0, it may prevent large increase of the total mass of the golf club.

The first portion of the reinforcing member may reinforce the shaft main body in an axial region including the position of the top end of the hosel to reduce the amount of the bending deformation occurring thereto. Thus, the shaft may be prevented from its breakage when hitting the golf ball. Furthermore, the first portion having its lowermost edge located between the tip end of the shaft and the top end of the hosel may further prevent from large increase of the total mass of the golf club.

DETAILED DESCRIPTION

An embodiment of the present invention will be explained below with reference to the accompanying drawings.

Figure 1:
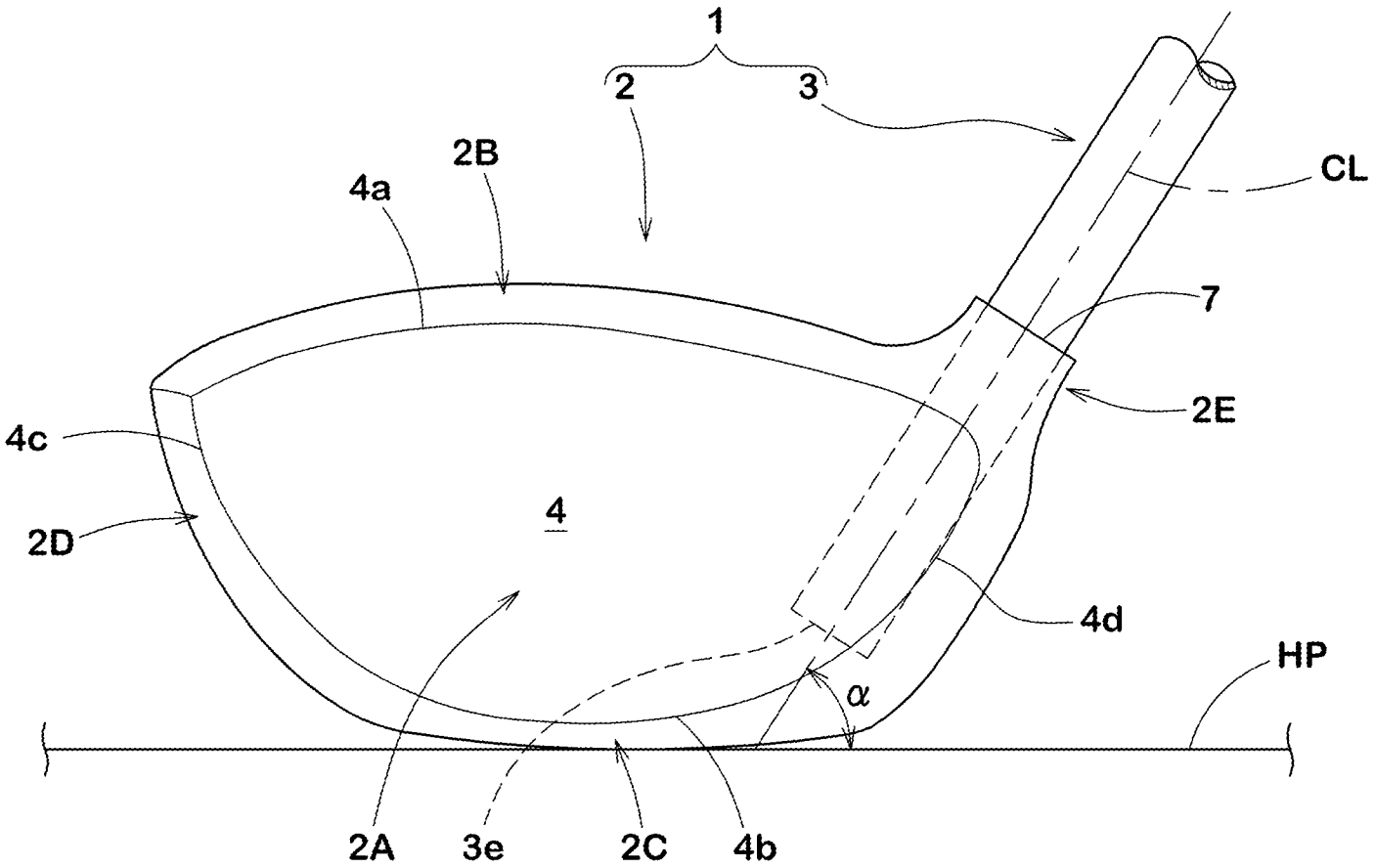
FIG. 1 is a partial front view illustrating a golf club in accordance with an embodiment of the present invention.
Figure 2:
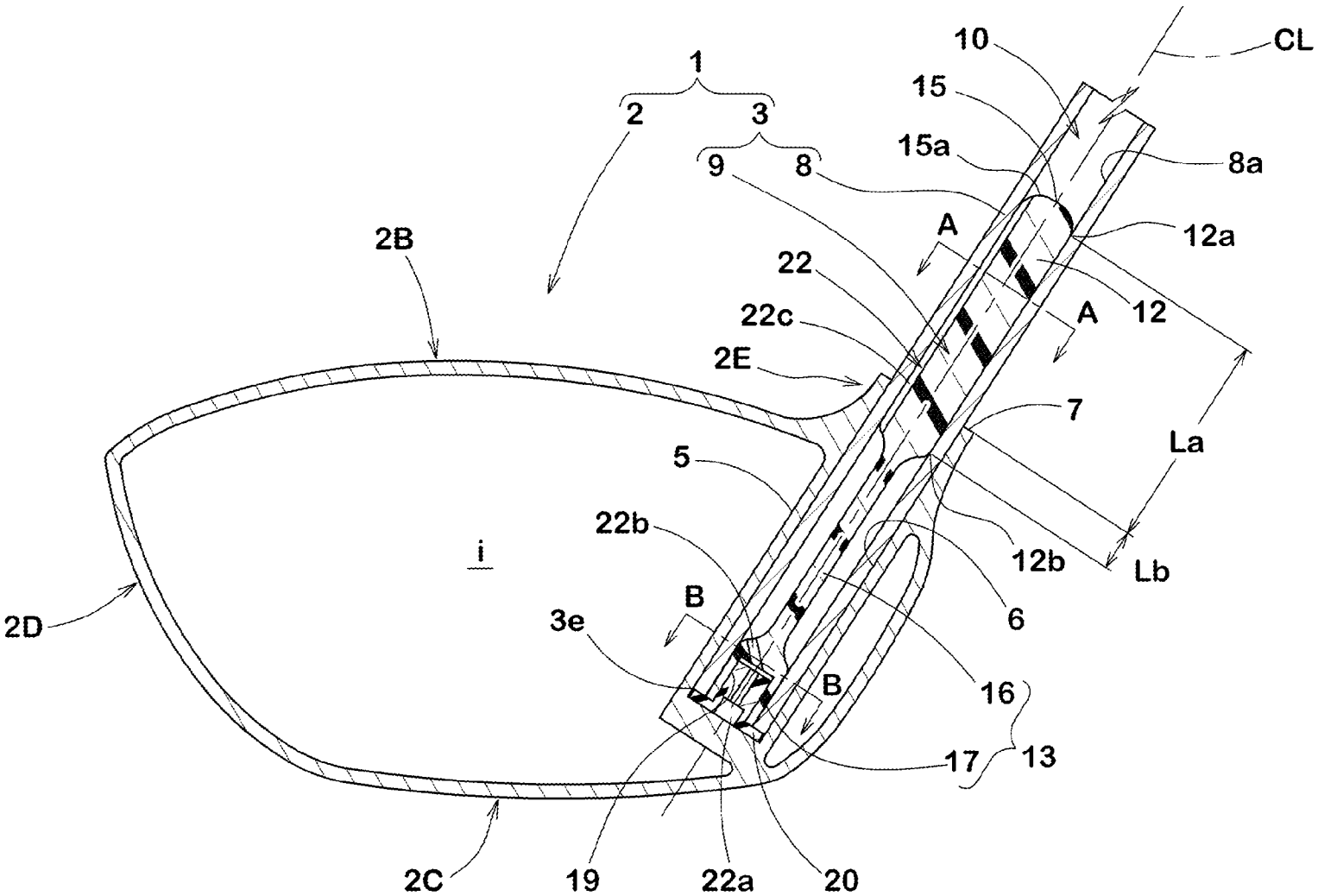
FIG. 2 is a cross-sectional view of the golf club of FIG. 1.

FIG. 1 is a partial front view illustrating a golf club 1 in accordance with an embodiment of the present invention, and FIG. 2 is a cross-sectional view of the golf club of FIG. 1. The golf club 1 includes a golf club head (which may be hereinafter simply referred to as a "head") 2, and a shaft 3.

The golf club 1 shown in FIG. 1 is under a standard state which the golf club 1 is placed on a horizontal plane HP at its specified lie angle α and loft angle (not shown). Here, the specified lie angle and loft angle mean the respective lie and loft angles that are defined or identified on the golf club 1. Unless otherwise noted, the golf club 1 shall be placed under the standard state.

In this embodiment, the head 2 is configured as a wood-type golf club head having a hollow (i) interior. The head 2 is made of metallic material. In another aspect of the embodiment, the head 2 is made of non-metallic material such as resin.

The head 2 includes a face portion 2A, a crown portion 2B, a sole portion 2C, a side portion 2D, and a hosel 2E.

The face portion 2A includes a hitting face 4 for striking a golf ball. The hitting face 4 has a traditionally laterally-long elliptical shape surrounded by an upper edge 4*a*, a lower edge 4*b*, a toe-side edge 4*c*, and a heel-side edge 4*d*.

The crown portion 2B extends rearward from the upper edge 4*a* of the hitting face 4 so as to form a top surface of the head 2.

The sole portion 2C extends rearward from the lower edge 4*b* of the hitting face 4 so as to form a bottom surface of the head 2.

The side portion 2D extends from the toe-side edge 4*c* of the hitting face 4 to the heel-side edge 4*d* of the hitting face 4 through a rear of the head between the crown portion 2B and the sole portion 2C.

The hosel 2E is provided on the heel side of the head 2 to attach the shaft 3 to the head 2. As shown in FIG. 2, the hosel 2E mainly includes a tubular body 5 having a top end 7. In this embodiment, the top end 7 of the hosel 2E is located upwardly with respect to the crown portion 2B.

The tubular body 5 extends downwardly from the top end 7 into the hollow (i) of the head 2. The tubular body 5 is provided with a shaft insertion hole 6 extending downwardly from the top end 7.

The shaft insertion hole 6 is a cylindrical space having an upper opening and a closed bottom. The configuration of the shaft insertion hole 6 is not particularly limited to such an embodiment described above.

The shaft 3 includes a shaft main body 8, and a reinforcing member 9.

The shaft main body 8 is made of a fiber reinforced resin to lower its weight and is formed into a tubular shape having a tip end 3*e*. Preferably, the shaft main body 8 extends from its butt end toward the tip end 3*e* so as to form a tapered shape.

The tip end part of the shaft main body 8 is fixed to the hosel 2E of the head 2. In this embodiment, the outer surface of the shaft main body 8 is bonded to the inner surface of the shaft insertion hole 6 by adhesive agent. The butt end side of the shaft main body 8 is attached a grip (not shown), for example.

The shaft main body 8 has an internal surface 8*a* which surrounds an axially extending cavity 10 therein. The cavity 10 extends from the butt end toward the tip end in a tapered manner.

The reinforcing member 9 is fixed in the cavity 10 of the shaft main body 8. In this embodiment, the reinforcing member 9 integrally includes a first portion 12 and a second portion 13.

Figure 3A:
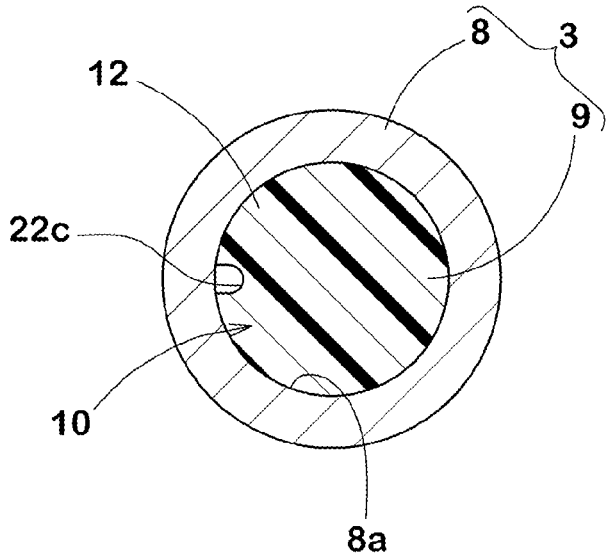
FIG. 3A is a cross-sectional view taken along line A-A in FIG. 2.

FIG. 3A illustrates a cross-sectional view taken along line A-A in FIG. 2. As shown in FIG. 3A, the first portion 12 has an axial member having a circular cross-section perpendicular to the shaft central axis CL. The first portion approximately fits the internal surface 8*a* of the shaft main body 8 except for a vent groove 22*c* for constituting a vent passage 22 which will be described later.

As shown in FIG. 2, the first portion 12 has an uppermost edge 12*a* and a lowermost edge 12*b* in the shaft axial direction.

The uppermost edge 12*a* of the first portion 12 is an uppermost position that comes into contact with the internal surface 8*a* of the shaft main body 8 in the shaft axial direction. The uppermost edge 12*a* of the first portion 12 is positioned upwardly with respect to the top end 7 of the hosel 2E.

The lowermost edge 12*b* of the first portion 12 is a lowermost position that comes into contact with the internal surface 8*a* of the shaft main body 8 in the shaft axial direction. The lowermost edge 12*b* of the first portion 12 is positioned between the top end 7 of the hosel 2E and the tip end 3*e* of the shaft main body 8. Namely, the lowermost edge 12*b* of the first portion 12 is positioned downwardly with respect to the top end 7 of the hosel 2E but upwardly with respect to the tip end 3*e* of the shaft main body 8.

Therefore the first portion 12 of the reinforcing member 9 may reinforce the shaft main body 8 from its internal surface 10 in an axial region including the position of the top end 7 of the hosel E. Since the reinforcing member reduces the amount of the bending deformation at the top end 7 of the hosel 2E when hitting a golf ball, it may prevent breakage of the shaft main body 8.

While, the lowermost edge 12*b* of the first portion 12 of the reinforcing member 9 is positioned upwardly with respect to the tip end 3*e* of the shaft main body 8. Accordingly, the first portion 12 may efficiently reinforce the shaft main body 8 while minimizing increase of the total mass of the golf club.

Preferably, the uppermost edge 12*a* of the first portion 12 is located in a distance La of from 5 to 50 mm in the shaft axial direction from the top end 7 of the hosel 2E. When the distance La is less than 5 mm, the advantage for reinforcing the shaft main body 8 by the first portion 12 may not be sufficiently obtained. When the distance La is more than 50 mm, the total mass of the golf club may excessively increase. In view of the above, the distance La is more preferably in a range of not less than 10 mm, still further preferably not less than 15 mm, but more preferably not more than 15 mm, still further preferably not more then 10 mm.

Since the shaft main body 8 is supported by the inner surface of the shaft insertion hole 6 in a region below the top end 7, a distance Lb between the lowermost edge 12*b* of the first portion and the top end 7 of the hosel 2E may be set in sp all with respect to the distance La in order to further lower the total mass of the golf club. Preferably, the distance Lb is set in a range of more than 0 mm, more preferably not less than 5 mm, but preferably not more than 20 mm, more preferably not more than 15 mm.

The reinforcing member 9 further includes a top portion 15 extending upwardly from the uppermost edge 12*a* of the first portion 12 while reducing its outer diameter. Preferably, in the cross-section of the top portion 15 including the shaft central line CL, the top portion 15 has an arc surface 15*a* having a radius of curvature in a range of not less than 0.5 mm, more preferably not less than 1 mm, still further preferably not less than 2 mm. In accordance with the present embodiment, the shaft main body 8 tends to be bent at or near the uppermost edge 12*a* when hitting a golf ball. Accordingly, to reduce an amount of bending deformation concentrating thereto, the top portion 15 preferably has a hemisphere-like shape.

The top portion 15 with a hemisphere-like shape helps to support the shaft main body 8 when hitting, and to reduce the stress concentration of the shaft main body 8 at the uppermost edge 12*a* of the first portion 12. Therefore the bending curvature of the shaft main body 8 when hitting becomes larger so as to disperse the bending stress in an axial wide area, thereby improving the endurance of the shaft main body 8. In another aspect of the embodiment, the top portion 15 may be formed into a tapered shape extending upwardly.

The second portion 3 of the reinforcing member 9 is provided downwardly respect to the first portion 12. In this embodiment, the second portion 13 integrally includes an axially extending thin portion 16 and a lower terminal end 17.

The thin portion 16 has an outer surface separate from the internal surface 8*a* of the shaft main body 8. In this embodiment, the thin portion 16 is configured as an axially extending member having a circular cross-section.

Figure 3B:
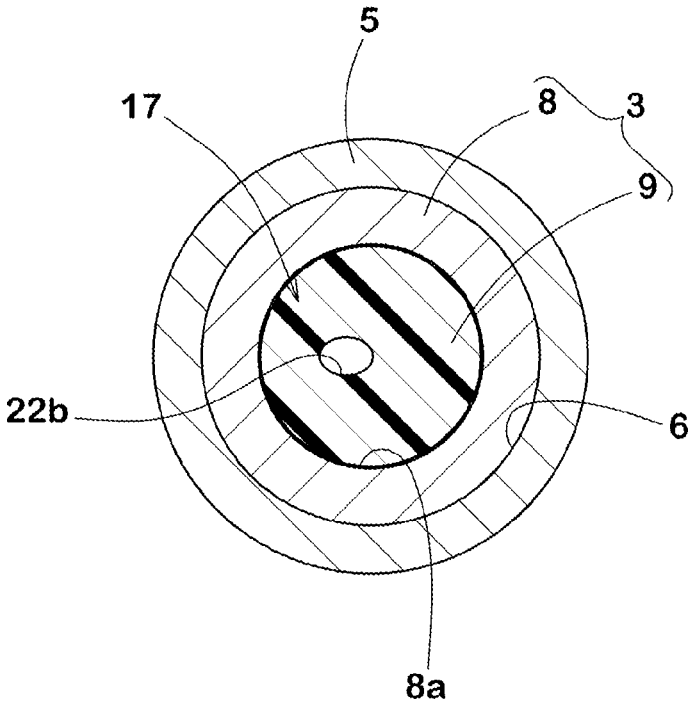
FIG. 3B is a cross-sectional view taken along line B-B in FIG. 2.

The terminal end 17 of the second portion 13 is fixed to the tip end 3*e* of the shaft main body 8. FIG. 3B illustrates a cross-sectional view taken along line B-B in FIG. 2. As shown in FIG. 3B, the terminal end 17 has an outer surface fitting the internal surface 8*a* of the shaft main body 8.

Figure 4:
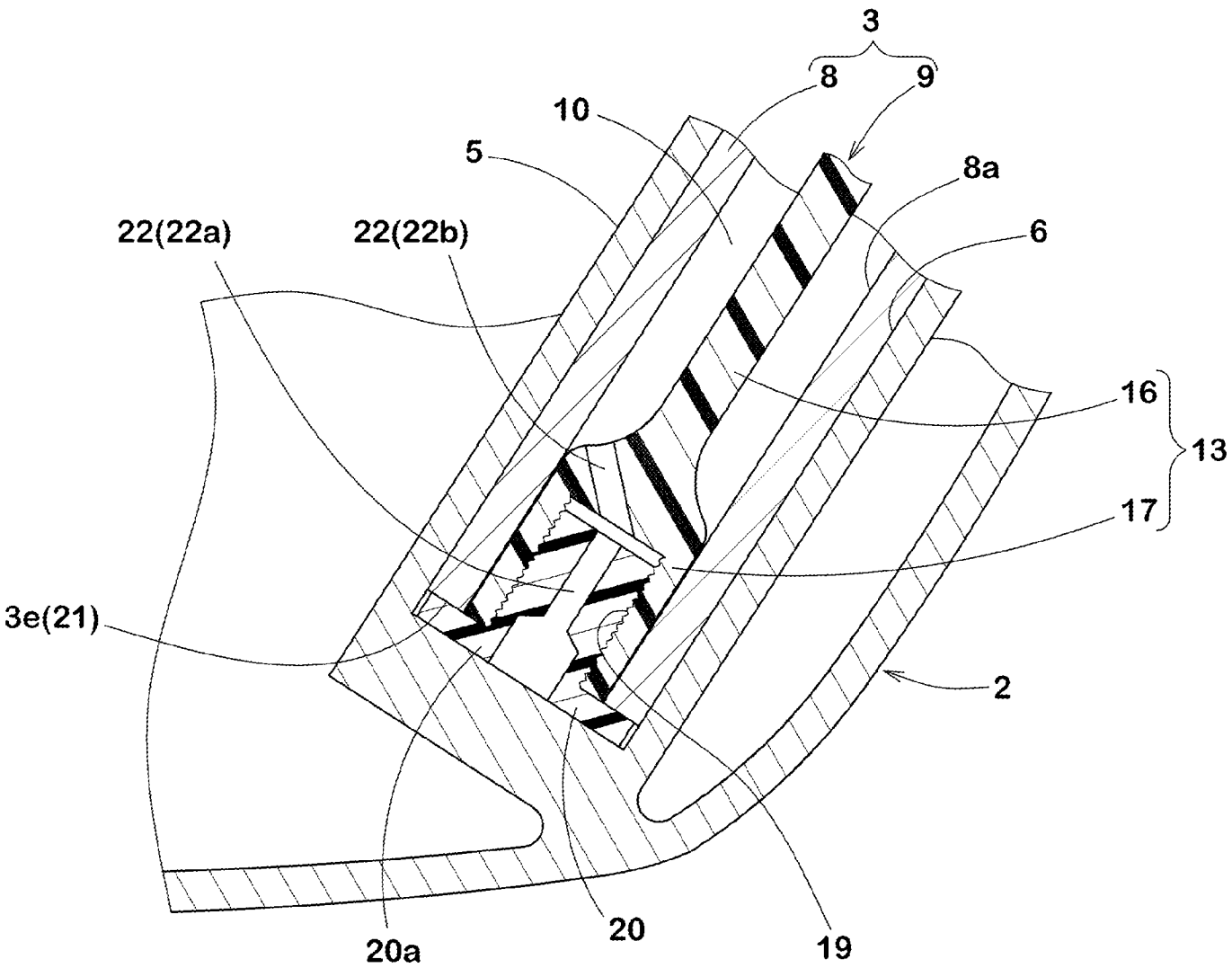
FIG. 4 is a partial enlarged view of an area including a tip end of a shaft of FIG. 2.

As shown in FIG. 4, the terminal end 17 has a threaded hole 19 extending upwardly from its bottom. A fastener 20 is fastened into the threaded hole 19 from the tip end 3*e* of the shaft main body 8. Since the fastener 20 includes a bolt head 20*a* coming into contact with the end face 21 of the tip end 3*e* of the shaft main body 8, it does not enter the cavity 10 of the shaft main body 8. Since the cavity 10 of the shaft main body 8 has a tapered shape, the reinforcing member 19 is drawn downwardly to firmly fit the internal surface 8*a* of the shaft main body 8 by fastening the fastener 20 into the threaded hole 19. The reinforcing member 9 therefore may be firmly fixed to the shaft main body 8 without a gap so that the shaft main body 8 is further reinforced. The bolt head 20*a* is fixed by being sandwiched between the shaft main body 8 and the bottom of the shaft insertion hole 6 of the hosel 2E.

In this embodiment, the second portion 13 may help to arrange the first portion 12 at the suitable position in the cavity 10 to reinforce the shaft man body 8. Furthermore, the thin portion 16 of the second portion 13 may vibrate in the cavity 10 due to an impact force when hitting a golf ball. This may absorb the vibration energy of the head 2, and offer good impact feeling to the golfer. Preferably, the thin portion 16 has an outer diameter in a range of from 1 to 3 mm in order to further improve the advantage described above.

The reinforcing member 9 is made of a material having a specific gravity in a range of not more than 2.0 so as to minimize increase of the total mass of the golf club. For the reinforcing member 19, metallic material, resin material, and fiber reinforcing resin may be employed. In this embodiment, the reinforcing member 19 is made of a resin.

In one aspect of the present embodiment for manufacturing the golf club 1, the shaft 3 is firstly assembled by fixing the reinforcing member 9 into the shaft main body 8. The reinforcing member 9 may be fixed to the shaft main body 8 by using an adhesive agent instead of the fastener 20. Next, the shaft main body 8 with the reinforcing member 9 is inserted into the shaft insertion hole 6 of the hosel 2E and then is bonded by an adhesive agent thereto.

In one aspect of the present embodiment, the reinforcing member 9 is provided with a vent passage 22. As shown in FIG. 4, the vent passage 22 includes the first groove 22*a* provided on the fastener 20. The first groove 22*a* axially extends through the fastener 20. The vent passage 22 further includes a second groove 22*b* that extends through the terminal end 17 of the reinforcing member 9. The second groove 22*b* extends from the bottom of the threaded hole 19 to the outer surface of the terminal end 17 with an inclination with respect to the shaft axial direction so as to include a first end communicated with the first groove 2*a* and a second end communicated with the cavity 10 of the shaft main body 8 around the thin portion 16.

As shown in FIG. 2, the vent passage 22 further includes a third groove 22*c* provided on the first portion 12 of the reinforcing member 9. The third groove 22*c* extends from the lowermost edge 12*b* to the uppermost edge 12*a* to communicate the air around the thin portion 16 with the cavity 10 axially upward of the reinforcing member 9.

At the time where the shaft 3 which comprises the shaft main body 8 and the reinforcing member 9 is inserted into the shaft insertion hole 6 of the hosel 2E, the vent passage 22 may help to exhaust the air between the bottom of the shaft insertion hole 6 and the tip end 3*e* of the shaft main body 8 toward the butt end of the shaft main body 8 through the cavity 10. It may improve the productivity of the golf club by offering the best position of the shaft 3 with respect to the head 2.

Although the present embodiment in accordance with the present invention is described employing the wood-type golf club, the present invention may be used for any kinds of golf clubs such as iron-type, utility-type and putter-type golf clubs.

While the particularly preferable embodiments of the present invention have been described in detail, the present invention is not limited to the illustrated embodiments, but can be modified and carried out in various aspects.

Comparison Test

Golf clubs having a basic structure of FIG. 1 except for the detail shown in Table 1 were manufactured and tested. Each first portion of the reinforcing member has a tapered shape from the uppermost edge to the lowermost edge as shown in Table 1. Major specifications of golf clubs and test methods are as follows.

Golf Club Head
- Total mass: 190 g
- Material: Titanium alloy
- Head shape: Wood-type Reinforcing Member
- Material: Polyamide resin
- Fastener: Polyamide resin Endurance Test:

Firstly, each tested golf club was installed a swing robot, and then the robot repetitively struck golf balls by the top end of the hosel of the golf club instead of the hitting face, while increasing the head speeds 2 m/s every two shots up when the golf club began to break. The test results are indicated in Table 1 by the head speed at which the golf club began to break, wherein the larger the value, the better the endurance is.

Test results are shown in Table 1. From the test results, it was confirmed that Example golf clubs in accordance with the present embodiment can be improved the endurance.

TABLE 1

| | Ref. 1 | Ref. 2 | Ex. 1 | Ex. 2 | Ex. 3 | Ex. 4 | Ex. 5 | Ex. 6 |
|---|---|---|---|---|---|---|---|---|
| Distance La from top end of hosel to uppermost edge of first portion of reinforcing member (mm) | — | 32 | 52 | 32 | 12 | 2 | 32 | 32 |

TABLE 1-continued

| | Ref. 1 | Ref. 2 | Ex. 1 | Ex. 2 | Ex. 3 | Ex. 4 | Ex. 5 | Ex. 6 |
|---|---|---|---|---|---|---|---|---|
| Diameter of first portion of reinforcing member at its uppermost edge (mm) | — | 6.23 | 6.32 | 6.23 | 6.14 | 6.1 | 6.23 | 6.23 |
| Distance Lb from top end of hosel to lowermost edge of first portion of reinforcing member (mm) | — | −2 | 4 | 4 | 4 | 4 | 2 | 22 |
| Diameter of first portion of reinforcing member at its lowermost edge (mm) | — | 6.05 | 6.05 | 6.05 | 6.05 | 6.05 | 6.05 | 6.05 |
| Diameter of thin portion of reinforcing member (mm) | — | 2 | 2 | 2 | 2 | 2 | 2 | 2 |
| Mass of reinforcing member (g) | 0 | 1.2 | 2.1 | 1.5 | 0.9 | 0.6 | 1.4 | 2.1 |
| Endurance test (m/s) | 26 | 25 | 41 | 40 | 32 | 30 | 35 | 40 |

What is claimed is:

1. A golf club comprising:

a golf club head; and a shaft, the golf club head comprising a hosel, the hosel formed into a tubular body having a top end and a shaft insertion hole extending downwardly from the top end, the shaft comprising a shaft main body and a reinforcing member, the shaft main body formed into a tubular shape having a tip end, and an internal surface surrounding axially extending cavity therein, the reinforcing member having a specific gravity in a range of not more than 2.0 and fixed in the cavity of the shaft main body, the reinforcing member comprising a first portion that comes into contact with the internal surface of the shaft main body directly, and the first portion having an uppermost edge and a lowermost edge, wherein the uppermost edge of the first portion is positioned upwardly with respect to the top end of the hosel, and the lowermost edge of the first portion is positioned between the top end of the hosel and the tip end of the shaft main body, and wherein the reinforcing member comprises a terminal end positioned at the tip end of the shaft main body, the terminal end is provided with a threaded hole extending upwardly from its bottom, and a fastener is fastened into the threaded hole from the tip end of the shaft main body.

2. The golf club according to claim 1, wherein the reinforcing member further comprises a second portion formed integrally with the first portion, and the second portion comprises an axially extending thin portion having its outer surface separating from the internal surface of the shaft main body.

3. The golf club according to claim 2, wherein the thin portion is provided downward with respect to the first portion.

4. The golf club according to claim 3, wherein the second portion further comprises its terminal end provided downwardly with respect to the thin portion, and the terminal end is fixed at the tip end of the shaft main body.

5. The golf club according to claim 1, wherein the reinforcing member further comprises a top portion extending upwardly from the uppermost edge of the first portion while reducing its outer diameter.

6. The golf club according to claim 5, wherein the top portion has a hemisphere-like shape.

7. The golf club according to claim 1, wherein the uppermost edge of the first portion is located in a distance of from 5 to 50 mm in a shaft axial direction from the top end of the hosel.

8. The golf club according to claim 1, wherein the lowermost edge of the first portion is located in a distance of not more than 20 mm in a shaft axial direction from the top end of the hosel.

9. The golf club according to claim 1, wherein the reinforcing member is provided with a vent passage which communicates a lower space of the first portion in the cavity with an upper space of the first portion in the cavity.

10. The golf club according to claim 1, wherein the first portion extends from the uppermost edge to the lowermost edge continuously in a shaft axial direction.

11. The golf club according to claim 1, wherein the fastener comprises a bolt head that comes into contact with an end face of the tip end of the shaft main body so as not to enter the cavity of the shaft main body.

12. The golf club according to claim 1, wherein the first portion has an axial member having a circular cross-section.

13. A golf club comprising:

a golf club head; and a shaft, the golf club head comprising a hosel, the hosel formed into a tubular body having a top end and a shaft insertion hole extending downwardly from the top end, the shaft comprising a shaft main body and a reinforcing member, the shaft main body formed into a tubular shape having a tip end, and an internal surface surrounding axially extending cavity therein, the reinforcing member having a specific gravity in a range of not more than 2.0 and fixed in the cavity of the shaft main body, the reinforcing member comprising a first portion fitting the internal surface of the shaft main body, and the first portion having an uppermost edge and a lowermost edge, wherein the uppermost edge of the first portion is positioned upwardly with respect to the top end of the hosel, and the lowermost edge of the first portion is positioned between the top end of the hosel and the tip end of the shaft main body, and wherein the reinforcing member is provided with a vent passage which communicates a lower space of the first portion in the cavity with an upper space of the first portion in the cavity.

14. A golf club comprising:

a golf club head; and a shaft, the golf club head comprising a hosel, the hosel formed into a tubular body having a top end and a shaft insertion hole extending downwardly from the top end, the shaft comprising a shaft main body and a reinforcing member, the shaft main body formed into a tubular shape having a tip end, and an internal surface surrounding axially extending cavity therein, the reinforcing member having a specific gravity in a range of not more than 2.0 and fixed in the cavity of the shaft main body, the reinforcing member comprising a first portion fitting the internal surface of the shaft main body, a second portion formed downward of the first portion, wherein the second portion comprises an axially extending thin portion having its outer surface separating from the internal surface of the shaft main body and a lower terminal end fixed to the tip end of the shaft main body and having an outer surface fitting the internal surface of the shaft main body, and the first portion having an uppermost edge and a lowermost edge, wherein the uppermost edge of the first portion is positioned upwardly with respect to the top end of the hosel, and the lowermost edge of the first portion is positioned between the top end of the hosel and the tip end of the shaft main body, and wherein the reinforcing member is provided with a vent passage which communicates a lower space with an upper space in the terminal end.

15. A golf club comprising:

a golf club head; and a shaft, the golf club head comprising a hosel, the hosel formed into a tubular body having a top end and a shaft insertion hole extending downwardly from the top end, the shaft comprising a shaft main body and a reinforcing member, the shaft main body formed into a tubular shape having a tip end, and an internal surface surrounding axially extending cavity therein, the reinforcing member having a specific gravity in a range of not more than 2.0 and fixed in the cavity of the shaft main body, the reinforcing member comprising a first portion that comes into contact with the internal surface of the shaft main body directly, and the first portion having an uppermost edge and a lowermost edge, wherein the uppermost edge of the first portion is positioned upwardly with respect to the top end of the hosel, and the lowermost edge of the first portion is positioned between the top end of the hosel and the tip end of the shaft main body, and wherein the reinforcing member further comprises a top portion extending upwardly from the uppermost edge of the first portion while reducing its outer diameter.

16. The golf club according to claim 15, wherein the top portion has a hemisphere-like shape.

* * * * *